US007975443B2

(12) United States Patent
Meyer et al.

(10) Patent No.: US 7,975,443 B2
(45) Date of Patent: Jul. 12, 2011

(54) PRECAST PRESTRESS RAISED ACCESS FLOOR CONSTRUCTION

(76) Inventors: Gary Meyer, Golden, CO (US); Charlie Johnson, Wheat Ridge, CO (US); Jim Blackledge, Denver, CO (US); Dan Parker, Arvada, CO (US); John Hanlon, Littleton, CO (US)

( * ) Notice: Subject to any disclaimer, the term of this patent is extended or adjusted under 35 U.S.C. 154(b) by 0 days.

(21) Appl. No.: 12/456,356

(22) Filed: Jun. 16, 2009

(65) Prior Publication Data

US 2009/0320393 A1 Dec. 31, 2009

Related U.S. Application Data

(60) Provisional application No. 61/132,259, filed on Jun. 17, 2008.

(51) Int. Cl.
*E04C 5/08* (2006.01)
*E04B 1/00* (2006.01)

(52) U.S. Cl. ..... 52/223.6; 52/250; 52/263; 52/506.06; 52/745.13

(58) Field of Classification Search ..... 52/250, 52/223.6, 263, 506.06, 385, 745.13
See application file for complete search history.

(56) References Cited

U.S. PATENT DOCUMENTS 1,205,465 A * 11/1916 Maguire et al. ..... 52/252
4,058,947 A * 11/1977 Earle et al. ..... 52/396.01
4,348,841 A * 9/1982 Ueno et al. ..... 52/126.5
4,809,474 A * 3/1989 Ekberg, Jr. ..... 52/223.6
4,901,490 A * 2/1990 Zinniel et al. ..... 52/263
4,922,670 A * 5/1990 Naka et al. ..... 52/126.6
4,924,639 A * 5/1990 Sato et al. ..... 52/167.2
4,972,537 A * 11/1990 Slaw, Sr. ..... 14/77.1
5,049,700 A * 9/1991 Kobayashi et al. ..... 174/482
5,072,557 A * 12/1991 Naka et al. ..... 52/126.6
5,301,480 A * 4/1994 Oyama et al. ..... 52/126.6
5,317,846 A * 6/1994 Michlovic ..... 52/220.4
5,540,524 A * 7/1996 Gonsalves ..... 405/257
5,809,712 A * 9/1998 Simanjuntak ..... 52/223.7
5,934,036 A * 8/1999 Gallagher, Jr. ..... 52/323
6,151,851 A * 11/2000 Carter ..... 52/236.3
7,007,431 B2 * 3/2006 Schubert ..... 52/263
7,168,212 B2 * 1/2007 Jette ..... 52/220.5
7,360,343 B1 * 4/2008 Spransy et al. ..... 52/263
2001/0037533 A1 * 11/2001 Doyle et al. ..... 14/73
2003/0066258 A1 * 4/2003 Chang ..... 52/387
2003/0182883 A1 * 10/2003 Won ..... 52/223.8
2005/0016100 A1 * 1/2005 Weiss ..... 52/389
2005/0102941 A1 * 5/2005 Barr ..... 52/459
2006/0230696 A1 * 10/2006 Sarkkinen ..... 52/223.6
2008/0308777 A1 * 12/2008 McCaleb ..... 254/98
2009/0301011 A1 * 12/2009 Kollegger et al. ..... 52/223.6
2010/0132283 A1 * 6/2010 Platt et al. ..... 52/223.6

* cited by examiner

*Primary Examiner* — Richard E Chilcot
*Assistant Examiner* — Mark R Wendell
(74) *Attorney, Agent, or Firm* — Scott L. Terrell, P.C.; Scott L. Terrell

(57) ABSTRACT

A precast prestress raised access floor construction is provided which includes a precast prestress concrete slab, having an upper base floor surface and a lower surface, a plurality of raised access floor panel pedestal support members bearing directly upon the upper base floor surface, and a plurality of raised access floor panels connected to the support means whereby a void is formed between the floor panels and the upper base floor surface.

5 Claims, 3 Drawing Sheets

PRECAST PRESTRESS RAISED ACCESS FLOOR CONSTRUCTION

CROSS REFERENCE TO RELATED APPLICATIONS

Pursuant to 35 U.S.C. 119(e), applicant claims the benefit of U.S. Ser. No. 61/132,259, filed, pursuant to 35 U.S.C. 111(b), on Jun. 17, 2008.

STATEMENT OF FEDERALLY SPONSORED RESEARCH

Not applicable.

BACKGROUND OF THE INVENTION

1. Field of the Invention

The present invention relates to a raised access floor construction. In particular, it relates to a precast prestress raised access floor modular construction utilizing precast concrete components, pedestal support members and raised access floor panels.

2. Description of the Related Art

Access floors are of a double floored construction and are commonly used to create a free space between a sub-floor and the normal working environment of a room. Raised access floor systems are so constructed that floor panels are mounted on a surface of a poured in place topping layer overlying a precast concrete system. The topping layer is necessary to level camber deflection in the precast prestress concrete base floor. The floor panels are mounted on the surface of the overlying topping layer, by means of support pedestal legs attached to base plates often glued to the topping layer, whereby an under floor air delivery system may be provided between the floor panels and the topping layer. The pedestal support legs are stationary and are typically attached to the surface of the topping layer at predetermined positions. A corner portion of each of the floor panels is disposed at the upper end of the stationary pedestal support leg. Such systems are so constructed so as to provide an easy distribution of cabling and ventilation, and such systems are well known in the art.

For example, U.S. Pat. No. 5,048,242 to Cline discloses an access floor system having a plurality of floor panels each having a pan and a cooperating top plate. The top plate is folded over a peripheral flange of the pan to define a hemmed edge. The support pedestal assembly includes a support plate configured to support the floor panels at their corners. T-shaped stringers are joined to the support plates in a grid-like pattern. The stringers are rigidly connected to the plates or snap-on to lock tabs defined by the plates. In this manner, the pedestals support the panels, at their corners, with additional support provided along the edges of the panels using the stringers. According to this construction, each pedestal support member is secured to a surface of a topping layer poured in place over the base floor or to a construction framed of wood.

In yet another example, U.S. Pat. No. 5,072,557 to Nake et. al., discloses a device for fixing floor panels mounted on a surface of a base floor by means of using support legs which permit vertical adjustment of the floor panels. The fixing device includes a retainer plate, fixed to the base floor, for receiving the support legs, a support member extending vertically from the retainer plate and having an internally threaded portion, a panel holder, and a bearing member for the panel holder. The bearing member includes one end thereof threaded into the internally threaded portion of the support member for rotatable movement of the bearing member relative to the retainer plate. The bearing member is adapted to be accessible through the floor panels for operation. The panel holder is adapted to be engageable with the bearing member in order fix the floor panels.

While the foregoing systems disclose a plurality of floor panels of a type supported at a corner portion of each of the floor panels by a stationary pedestal support leg, a problem exists in the prior art when constructing an access floor on precast prestress concrete slabs because the slabs necessarily include a camber deflection which, requires the poured in place topping layer, or diaphragm, overlying the precast concrete slab in order to create a level surface for mounting the pedestal support legs. However, the poured in place overlying topping layer must be left in place for a sufficient time, often many days, to allow the topping layer to cure until it develops adequate strength. This eliminates the rapid erection advantage of precast prestress concrete construction over a poured in place construction and also increases building height. Therefore, what is needed is a precast prestress concrete construction for a raised access floor utilizing both precast prestress concrete floor slabs and raised access floor panels without the necessity of applying a poured in place overlying topping layer, framed construction, or diaphragm to overcome the camber deviation. The present invention satisfies these needs.

BRIEF SUMMARY OF THE INVENTION

It is therefore an object of the present invention to provide a raised access floor construction which utilizes both precast and prestress concrete modular components and raised access floor components to overcome the camber deflection without the need for a topping layer which is poured or framed, on site.

It is another object of the present invention to provide a precast prestress concrete construction for an under floor air delivery system utilizing both precast concrete floor slabs and raised access floor panels without the necessity of applying an overlying poured in place topping layer, or diaphragm.

It is yet another object of the present invention to provide a precast prestress concrete construction for an under floor air delivery system utilizing both precast concrete floor slabs and raised access floor panels without the necessity of applying an overlying poured in place topping layer, or diaphragm, to level the surface which is applicable to each of the floors of a building.

To overcome the problems of the prior art and in accordance with the purpose of the invention, as embodied and broadly described herein, briefly, a precast prestress raised access floor construction is provided which includes a precast prestress concrete slab, having an upper base floor surface and a lower surface, a plurality of raised access floor panel pedestal support members bearing directly upon the upper base floor surface, and a plurality of raised access floor panels connected to the support means whereby a void is formed between the floor panels and the upper base floor surface.

Additional advantages of the present invention will be set forth in part in the description that follows and in part will be obvious from that description or can be learned from practice of the invention. The advantages of the invention can be realized and obtained by the apparatus particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and together with the description explain the principles of the invention.

DETAILED DESCRIPTION OF THE DRAWINGS

Unless specifically defined otherwise all technical or scientific terms used herein have the same meaning as commonly understood by one of ordinary skill in the art to which this invention belongs. As used herein the term prestress is also directed to a concrete slab having a poststress tension deflection generated subsequent to installation.

Although any methods and materials similar or equivalent to those described herein can be used in the practice or testing of the present invention, the preferred methods and materials are now described. Reference will now be made in detail to the presently preferred embodiments of the invention examples of which are illustrated in the accompanying drawings wherein like numerals represent like features.

Figure 1:
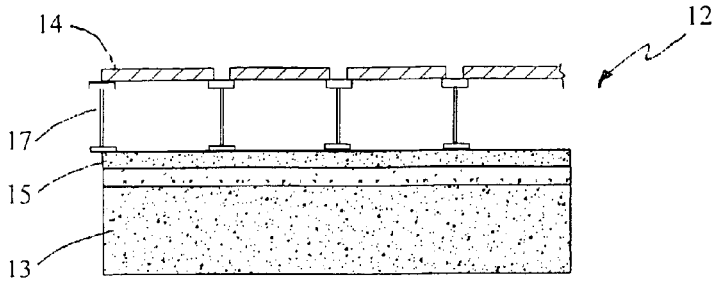
FIG. 1 is a side view of a traditional raised access floor panel construction.

The present invention provides a modular precast concrete raised access floor construction. As shown in FIG. 1, in the tradition manner of construction 12, the precast prestress concrete slab 13 is formed at a concrete plant. Because, for long spans, the precast concrete slab is a prestress design, the prestress concrete slab 13 necessarily includes a camber deflection. The prestress concrete slab is delivered to a construction site for use in forming a base floor. An overlying topping slab 15 is then poured in place, on site, and allowed to cure, in order to resolve the camber issue, and thereby result in a substantially planar surface for attaching a plurality of equally spaced base plates. Pedestal support members 17, are then attached to the base plates. Raised access floor panels 14 are then securely fastened to the pedestal support members with connectors, such as a threaded connectors.

Figure 2:
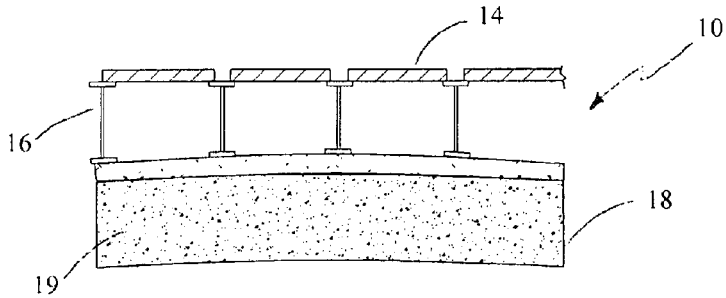
FIG. 2 is a side view of the present invention showing the modular precast prestress concrete construction.

As shown in FIG. 2, the present invention represents an improvement over the traditional art for resolving the camber deflection which is a necessary structural component in precast prestress concrete slab, having a span greater than 7.62 meters, by eliminating the need for the overlying, poured in place, topping slab 15 and which also provides a modular system for a rapid and universal erection of the precast prestress concrete floor construction 10. In accordance with the present invention, precast concrete slab 18 includes a plurality of downwardly and vertically extending equally spaced ribs 19, such as a "T" shaped rib. The precast concrete slab 18 generally includes a camber or deflection and may, but need not, include a plurality of equally spaced portions for attaching the base plates used in connecting the pedestal support legs 16 directly to the precast concrete slab. As such, a modular assembly is shipped to the construction site and connected to other modules using hook plates between the joints of the modules. The precast modules may, but need not, include a way of attaching the base plates, such as forming channels, recesses, or fasteners, at predetermined positions along an upper surface of the concrete base floor, and/or the base plates together with pedestal support legs 16 preassembled to the base plates, or even a completed raised access floor assembly wherein the precast concrete slab 18, base plates, pedestal support legs 16, and floor panels 14 are preassembled for final delivery to the construction site. Moreover, the pedestal support legs 16 may further include both internally and externally threaded portions for final adjustment of a vertical height of the support leg 16, in a range of 2.54 cm to 11.43 cm, in order to achieve a finished planer floor surface. The floor panels are desirably of a 0.372 sq. meter dimension, but may be constructed of any dimension relative to the architectural design criteria for the raised access floor to be constructed. The floor panels may also include both horizontal and vertically adjustable members, such as vertically adjustable threaded members or horizontally adjustable floor panel corner portions are diagonally adjustable in relation to a sidewall of the floor panel, for universal fit with the modular system. Thus, in accordance with the present invention, the precast concrete floor modular construction 10 is both manufactured in one or more locations and installed directly on site to overcome the camber deflection of the prestress concrete base floor without the need to flood coat a concrete leveling layer or build up the base floor using a framed leveling layer made of wood.

Figure 3:
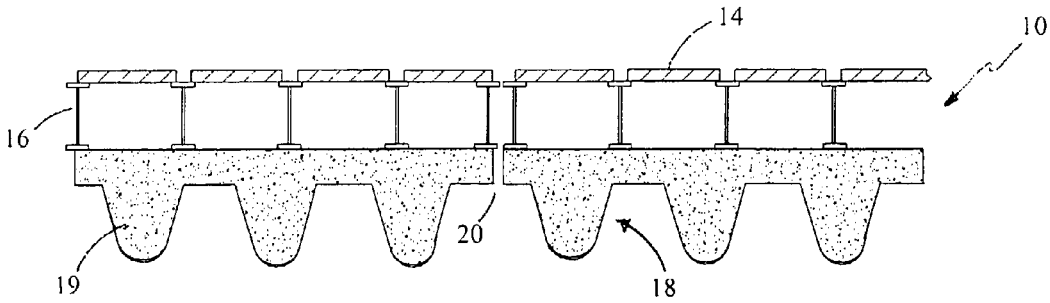
FIG. 3 is a front view of the present invention showing the modular precast prestress concrete rib portion, access floor panels, support pedestals, and the application of the fire caulk, or grout.

As shown in FIG. 3, a frontal view of the above embodiment, a plurality of precast concrete slabs 18 are longitudinally connected adjacent to one another. As illustrated, a sealant 20, such as a fire caulk or grout, may be applied between concrete slabs 18. The sealant 20 may also serve as a fire protection barrier.

Figure 4:
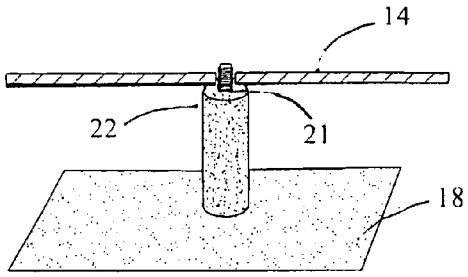
FIG. 4 is an alternative embodiment of the present invention wherein the precast prestress concrete slab includes a plurality of equally spaced concrete columns extending upwardly from the upper surface of the precast concrete slab.

FIG. 4 represents an alternative embodiment of the present invention wherein the precast concrete slab 18 includes a plurality of equally spaced precast concrete columns 22 extending vertically and upwardly from the upper surface of the precast concrete slab 18. The precast concrete columns 22 are preferably of a single manufacture together with the concrete slab 18 and may, but need not, include floor panel bearing plates 21, such as drop-in face plates, for connecting the floor panels 14 to the columns 22. As can be appreciated from the description herein, an under-floor air delivery system may be provided as the air circulates through columns 22 and in a void created between floor panels 14 and the upper surface of the precast concrete slab 18.

Figure 5:
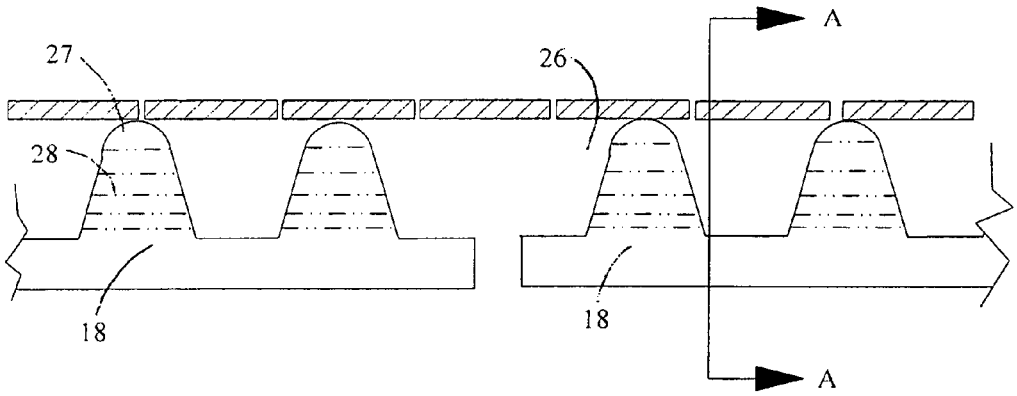
FIG. 5 is yet another embodiment of the present invention showing a plurality of equally spaced precast rib portions, having a plurality of clear holes or slots, in the precast concrete slab extending vertically from the upper surface of the precast concrete slab.
Figure 6:
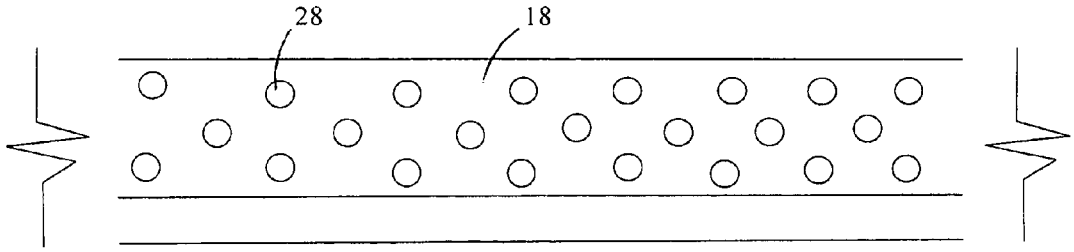
FIG. 6 is a sectional view along section A of FIG. 5 showing a preferred construction of the clear holes relative to the precast member.

FIG. 5 represents yet another embodiment of the present invention wherein a plurality of equally spaced precast rib portions 27, precast with a plurality of clear holes 28, channels or slots, in the precast concrete slab 18 and/or the rib portions 27. The rib portions 27 extend vertically and upwardly, from the upper surface of the precast concrete slab 18. In this manner, the clear holes may be used to provide the under floor air circulation or as a conduit for locating electrical cables, and the like. The rib portions 27 support and connect to the floor panels 14 by any conventional means. FIG. 6, is a sectional view along section A of FIG. 5, and illustrates a configuration of the clear holes 28 formed in a transverse relationship to the directional length of the rib portions 27.

Figure 7:
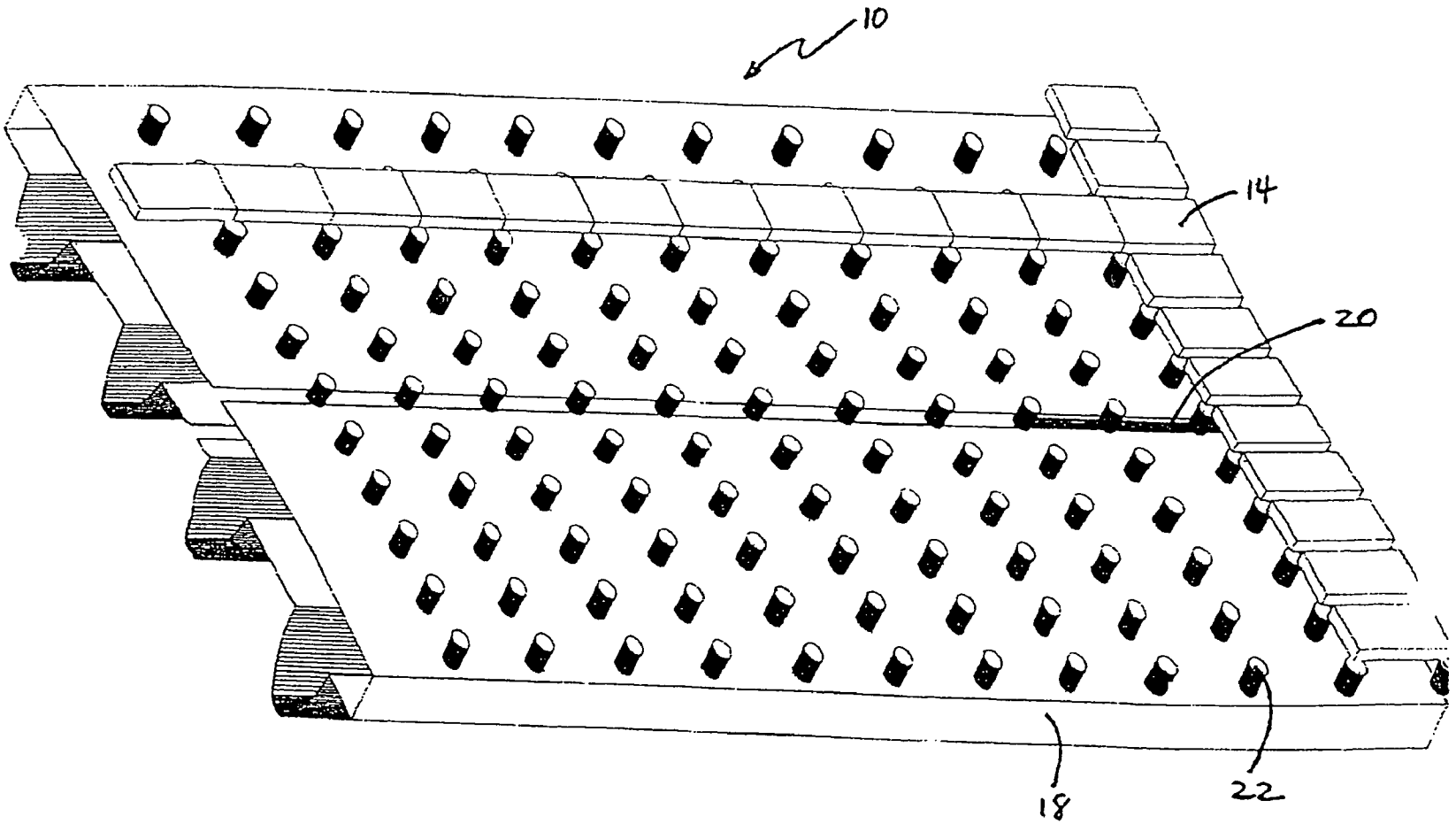
FIG. 7 is an isometric view of the embodiment shown in FIG. 4.

FIG. 7 is an isometric view of the precast concrete slabs 18 and precast concrete columns 22 for supporting floor panels 14 and providing under floor air delivery between floor panels 14 and the precast concrete slab 18. The concrete columns 22 are equally spaced and extend vertically and upwardly from the upper surface of the precast concrete slabs 18.

The foregoing precast prestress raised access floor is a modular system which eliminates the need for constructing a topping layer, on site, to overcome the camber deflection which is low cost in manufacturer and also which utilizes the rapid erection advantage inherent with precast concrete structures. Elements of the construction are either completed at the manufacturer and shipped on site, or may be assembled on site by the installer.

While the present invention has been described in connection with the illustrated embodiments, it will be appreciated and understood that modifications may be made without parting, from the true spirit and scope of the invention.

We claim:

1. A method for constructing as raised access floor, comprising:

(a) forming a plurality of precast prestress concrete modules having an upper and a lower surface, the upper surface including a plurality of pedestal base plate attachment surfaces adapted for receiving a pedestal base plate member;

(b) transporting the modules to a building site for installation;

(c) attaching a plurality of pedestal base plate members to the attachment surfaces, a plurality of pedestal support members to the base plate members, and a plurality of pedestal head members to the pedestal support members;

(d) assembling a stringer system connecting the pedestal support head members;

(e) vertically adjusting the pedestal support members in order to horizontally align the stringer system; and (f) attaching a plurality of floor panels to the pedestal support heads.

2. A method for constructing a raised access floor, comprising, (a) forming a plurality of precast prestress concrete modules having an upper and a lower surface;

(b) transporting the modules to a building site for installation;

(c) attaching a plurality of pedestal base plate members to the attachment surfaces, a plurality of pedestal support members to the base plate members, and a plurality of pedestal head members to the pedestal support members;

(d) assembling a stringer system connecting the pedestal support head members;

(e) vertically adjusting the pedestal support members in order to horizontally align the stringer system; and (f) attaching a plurality of floor panels to the pedestal support heads.

3. A precast prestress raised access floor construction, comprising:

(a) a precast prestress concrete slab having an upper base floor surface and a lower surface, the upper surface including a plurality of vertical concrete rib portions having a plurality of clear holes, or slots; and (b) a plurality of raised access floor panels connected to the concrete rib portions whereby a void is formed between the floor panels and the upper base floor surface.

4. The precast prestress raised access floor construction according to claim 3, wherein the construction comprises a plurality of the precast prestress concrete slabs including lateral edges connected in longitudinal alignment with a fastener.

5. The precast prestress raised access floor construction, according to claim 4, further comprising a fireproof sealant applied along a seam formed by the lateral edges of the slabs.

* * * * *